US007588391B2

(12) United States Patent
Bussey, III et al.

(10) Patent No.: US 7,588,391 B2
(45) Date of Patent: Sep. 15, 2009

(54) DRAINAGE ELEMENT

(76) Inventors: Buddy Harry Bussey, III, 4 Windy Hill, Atlantic Highlands, NJ (US) 07716; Harry Bussey, Jr., 960 Cape Marco Dr., Unit 1803, Marco Island, FL (US) 33937

( * ) Notice: Subject to any disclaimer, the term of this patent is extended or adjusted under 35 U.S.C. 154(b) by 0 days.

(21) Appl. No.: 12/290,411

(22) Filed: Oct. 30, 2008

(65) Prior Publication Data

US 2009/0074512 A1 Mar. 19, 2009

Related U.S. Application Data

(63) Continuation-in-part of application No. 12/001,703, filed on Dec. 12, 2007, which is a continuation-in-part of application No. 11/637,534, filed on Dec. 12, 2006, now Pat. No. 7,475,477, which is a continuation-in-part of application No. 11/591,420, filed on Nov. 2, 2006.

(51) Int. Cl.
*E02B 11/02* (2006.01)

(52) U.S. Cl. ..... 405/43; 405/50

(58) Field of Classification Search ..... 405/43, 405/45, 46, 50

See application file for complete search history.

(56) References Cited

U.S. PATENT DOCUMENTS

| | | | | |
|---|---|---|---|---|
| 3,403,519 | A * | 10/1968 | Balko | 405/45 |
| 4,983,068 | A * | 1/1991 | Kozak et al. | 405/36 |
| 6,854,924 | B2 * | 2/2005 | Ring | 405/45 |
| 2005/0063781 | A1 * | 3/2005 | Bussey et al. | 405/43 |

* cited by examiner

*Primary Examiner*—John Kreck
(74) *Attorney, Agent, or Firm*—Francis C. Hand; Carella, Byrne, Bain et al.

(57) ABSTRACT

The preassembled drainage element is made with a water permeable membrane sleeve that has slits placed in the peripheral portion of the sleeve that is to form the bottom of the drainage element. The aggregate is post-expandable after fabrication of the drainage element so as to widen the slits and cause the periphery of the drainage element to bulge in the sections containing the slits.

8 Claims, 2 Drawing Sheets

DRAINAGE ELEMENT

This is a Continuation-in-Part of U.S. Ser. No. 12/001,703, filed Dec. 12, 2007, which is a Continuation-in-Part of U.S. Ser. No. 11/637,534, filed Dec. 12, 2006 no U.S. Pat. No. 7,475,477 which is a Continuation-in-Part of U.S. Ser. No. 11/591,420, filed Nov. 2, 2006, the specifications of which are incorporated by reference herein.

This invention relates to a drainage element. More particularly, this invention relates to a drainage elements having a discrete aggregate encased in a water permeable filter material.

As previously described, a drainage element can be made with a mass of discrete aggregate within a sleeve of water-permeable filter material wherein the sleeve has a longitudinally extending pattern of slits in a peripheral portion thereof.

It is an object of this invention to improve the techniques for making a preassembled drainage element with a membrane material with slits in a peripheral potion.

It is another object of the invention to provide an improved drainage element.

Briefly, the invention is directed to a drainage element comprised of a mass of discrete aggregate defining passageways for a flow of fluid therethrough, a sleeve of water-permeable filter material encasing the mass of discrete aggregate and an optional perforated pipe embedded and extending through the aggregate.

The water-permeable filter material typically has a plurality of interstices characterized in being of a size for the passage of water therethrough and the filtering of fine particles of solid material from water passing through said membrane. When in place in a trench or the like, soil particles and the like are blocked from entering into the drainage element while water and other fluids may pass through the membrane sleeve and aggregate into the drain pipe embedded therein.

The slits are located in a peripheral portion of the sleeve that is to form the bottom of the drainage element when in place and constitute less than 50% of the total periphery of the sleeve. The slits are arranged in parallel rows coaxially of the axis of the drainage element so that the slits may be readily formed in the membrane material before or during fabrication of the drainage element. Alternatively, the slits may be formed in parallel rows transverse to the axis of the drainage element, i.e. circumferentially of the drainage element. Also, the slits may be formed in longitudinally spaced apart sections of the sleeve.

The drainage element is made in a manner as described in the parent application Ser. No. 12/001,703. After manufacture, the drainage element is allowed to cure in an ambient atmosphere as described in copending patent application Ser. No. 11/248,753, filed Oct. 12, 2005 (US 2007/0080573) so that the synthetic aggregate, i.e. foamed polystyrene, expands causing the portion of the membrane sleeve containing the slits to expand radially.

Where the slits are formed in longitudinally spaced apart sections, only those sections expand radially thereby giving the drainage element a lumpy appearance.

The expansion of the slit portions of the membrane material also opens the slits to a wider degree. This, in turn, allows a greater outlet area for the outflow of water or other liquid passing downwardly out of the drainage element.

These and other objects and advantages of the invention will become more apparent from the following detailed description taken in conjunction with the accompanying drawings wherein.

Figure 1:
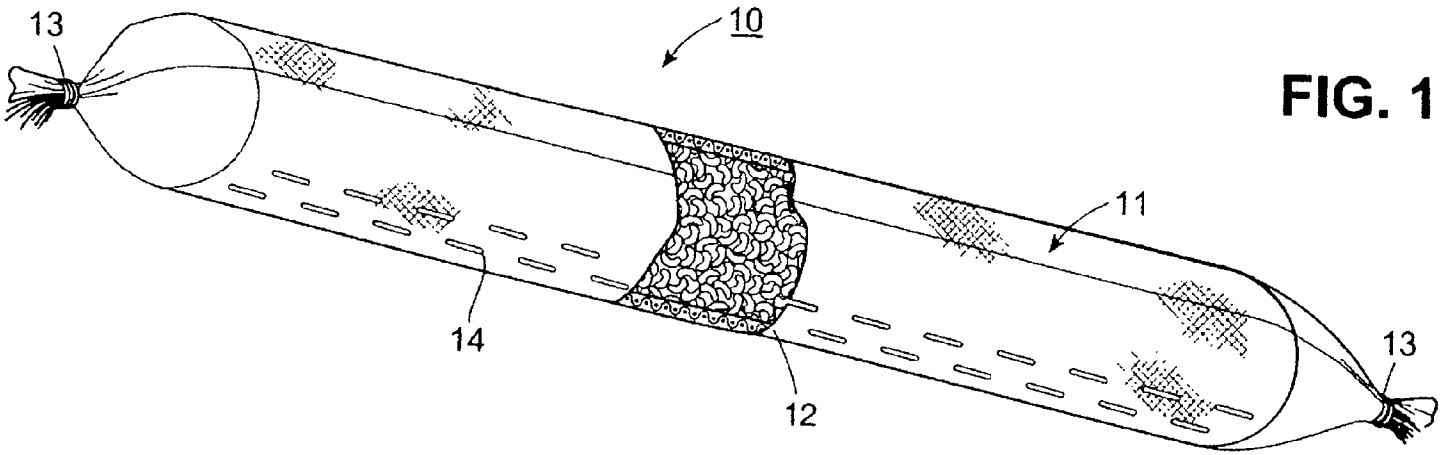
FIG. 1 illustrates a perspective view of a drainage element in accordance with the invention.

Referring to FIG. 1, the drainage element 10 is comprised of a tubular sleeve 11 and a mass of aggregate 12 made of an expanded thermoplastic material within the sleeve 11. The aggregate 12 is made of discrete elements of a size to define passageways for a flow of fluid therethrough.

The tubular sleeve 11 encases the mass of discrete aggregate 12 and is made from a web that is formed into the tubular sleeve 11, seamed longitudinally and gathered together at each end with tie means 13, for example in the form of ties, closing around each gathered end of the sleeve 11 to retain the aggregate 12 therein.

The drainage element 10 may have a pipe extending completely therethrough, may have a pipe extending from one end only or no pipe at all.

The tubular sleeve 11 is made of a water-permeable membrane that is tear resistant and water-permeable with a plurality of interstices characterized in being of a size for the passage of water therethrough and the filtering of fine particles of solid material from the water passing through the membrane 11. The membrane 11 is made from a web of spun bonded polyester material as described in the above-noted parent applications.

The drainage element 10 is made on apparatus as described in copending application, U.S. Ser. No. 12/001,703 that includes a supply station having means to support a roll of the membrane 11 for delivery of a web of the membrane 11 to a tube disposed on a horizontal axis.

Figure 2:
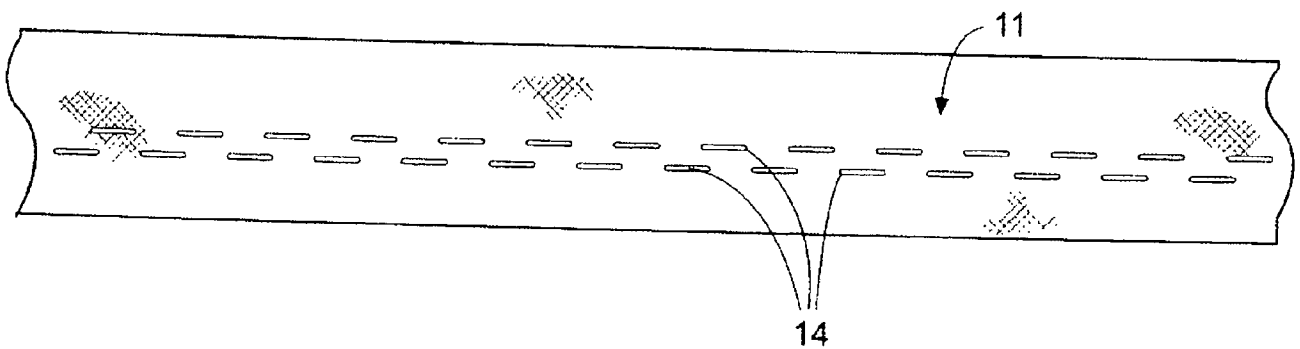
FIG. 2 illustrates a sectional view of a membrane used to make a sleeve for a drainage element with a pattern of slits in accordance with the invention.

Referring to FIG. 2, the web of membrane 11 may be previously fabricated with slits 14 or the slits 14 may be formed in the web of membrane during the manufacture of a drainage unit prior to the web being formed into a tubular sleeve. The slits 14 are arranged in parallel rows coaxially of the axis of the web of membrane or in parallel rows transversely of the web. The slits 14 may also be arranged in an even pattern, as shown, or in a staggered pattern. Also, the slits 14 may be formed in longitudinally spaced apart sections of the web of membrane 11.

The longitudinally extending pattern of rows of slits 14 is formed in a portion of the web that is to form the bottom of the drainage element 10 when in place, particularly in a septic system, and that constitutes less than 50% of the total periphery of the resultant sleeve 11. These slits 14 are formed in any suitable manner, for example, by a plurality of pins that have a chisel-like tip or a knife. For the purpose of clarity, the slits 14 are illustrated in each of FIGS. 1 and 2 as narrow rectangular shaped openings.

For example, each slit 14 may have a length of one inch and may be laterally spaced from an adjacent slit 14 a distance of one inch and longitudinally spaced from an adjacent slit 14 a distance of one inch relative to the axis of the sleeve 11. The slits 14 may be of any length, for example, of from 1/16 inch to one inch or more, so long as the pieces of aggregate 12 are retained in place.

The apparatus for making the drainage element 10 also has a forming means, for example, in the form of a plurality of longitudinally spaced pairs of guide plates can be angularly disposed about the tube in a progressive pattern. Each pair of guide plates serves to guide the delivered web about the tube in order to progressively bring the longitudinal edges of the web into overlapping relation. Alternatively, a forming collar can be used as the forming means to form the delivered web into a tube with overlapping longitudinal edges.

The apparatus also includes a securing means for securing the overlapped edges of the membrane 11 together to form the sleeve 11 about the tube. This securing means includes a valve for expelling a glue or adhesive between the overlapped edges as well as a nozzle for applying a stream of air under pressure onto the overlapped edges and glue to press the glue into each of the longitudinal edges to secure the overlapped edges of the membrane 11 together to form a strong seam.

The remainder of the apparatus is as described in above-noted copending parent patent application that is incorporated by reference herein.

The drainage element 10 is to be arranged in a trench, ditch, or the like so that the slit portion of the membrane 11 is at the bottom of the element 10. In this arrangement, soil will not infiltrate into the drainage element 10 from above. On the other hand, water may pass through the membrane material. Further, in the event that larger particles do pass into the drainage element 10, for example, in a septic field, these particles may easily flow through the slits 14 in the material 11 at the bottom.

The slits 14 in the sleeve of membrane material 11 being placed at the bottom of a drainage element 10 allows soil, stones and the like that infiltrate into the drainage element to be passed through the bottom of the drainage element without accumulating within the drainage element. This avoids clogging of the drainage element in use over time, particularly with septic effluent when used in a septic system. The size of the slits 14 are made to accommodate the passage of infiltrating debris, such as dirt and stones while, retaining the aggregate in place.

Figure 3:
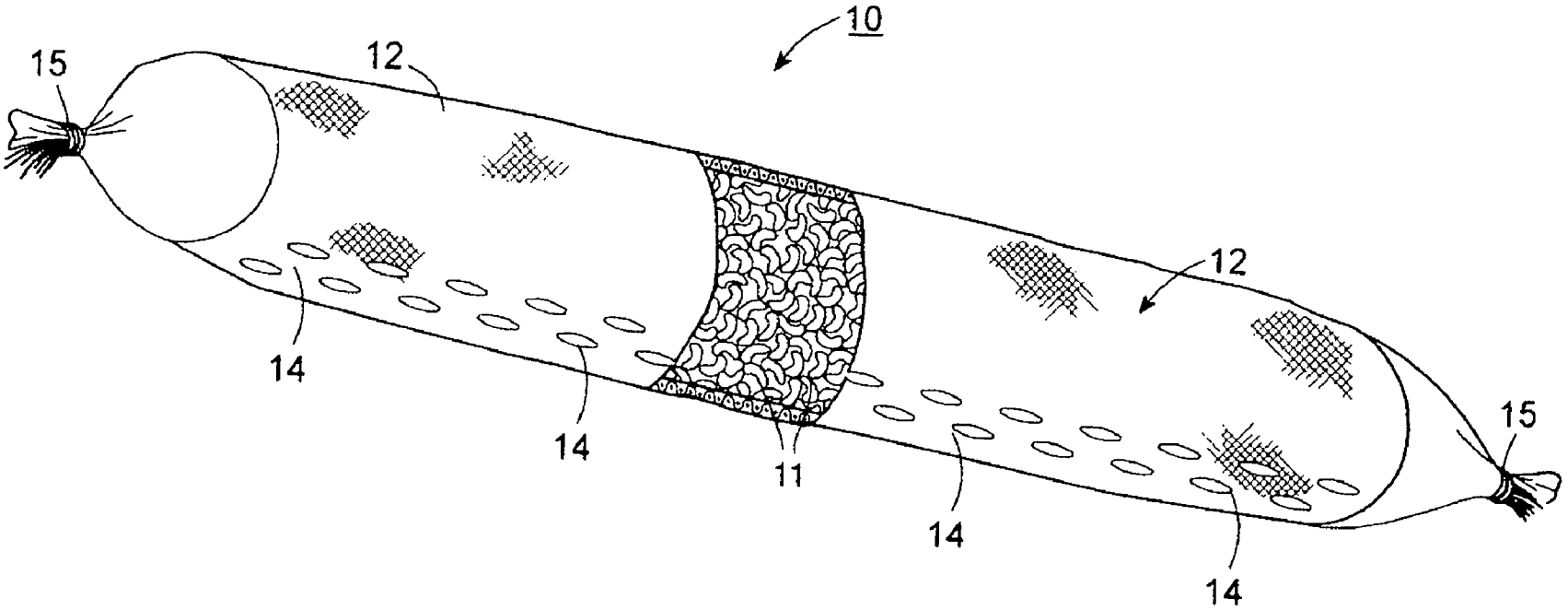
FIG. 3 illustrates a perspective view of a drainage element in accordance with the invention after curing of the aggregate and opening of the slits.

The mass of aggregate 12 within the sleeve 11 is, preferably, made of expanded polystyrene elements characterized in having been expanded from an initial state to an expanded state after filling of the sleeve 11 therewith and in imparting a degree of rigidity to the drainage element 10 in the expanded state sufficient to maintain an expanded three dimensional shape of the sleeve 11. That is to say, the aggregate 12 is post-expandable, as described in copending application, U.S. Ser. No. 11/248,753. As a result, the expansion of the aggregate imposes a radially expanding force on the sleeve (membrane) 11 that, in turn, causes the slits 14 to open to an oblong shape as shown in FIG. 3 and the adjacent parts of the membrane 11 to bulge radially. Thus, the finished drainage element 10 is characterized in having slits 14 that are of oblong shape and in having the peripheral portion of membrane (sleeve) 11 radially outwardly bulged.

The pattern of slits 14 extends along the longitudinal length of the sleeve 11, and preferably along at least one-eighth of the length of the sleeve 11. Further, the pattern of slits 14 may be formed of a plurality of longitudinally spaced apart sections of slits 14 with the slits 14 in each said section being disposed in parallel. The slits 14 in each section may be transverse to or coaxial of the longitudinal axis of the sleeve 11.

The expansion of the slit portions of the membrane 11 material also opens the slits 14 to a wider degree. The opening up of the slits 14, for example, to a width of 1/32 inch or more at the center, allows a greater outlet area for the outflow of water or other liquid passing downwardly out of the drainage element 10. The size of the opening created by the expansion of a slit 14 depends on the length of the slit 14, i.e. the longer the slit, the greater the width of the slit at the center, and the amount of post-expansion (curing) of the aggregate 12, i.e. the more the aggregate 12 post-expands, the greater the width of the slit at the center.

The drainage element may also be made as described in U.S. Ser. No. 11/637,534 wherein the sleeve encasing the aggregate is with a part-peripheral portion of net material with large openings and a part-peripheral portion of water-permeable filter material. In this embodiment, the slits would be formed in the water-permeable filter material as above.

The drainage element 10 may include a perforated pipe that passes through the aggregate 12 in known manner. In this regard, the drainage element may be used in a septic system wherein effluent passes through the perforated pipe, into and through the aggregate 12, through the sleeve 11 and into the ground. Also, the drainage element may be used for drainage wherein water enters through the sleeve 11 and passes into the perforated pipe to be drawn off. In this latter case, the bottom half of the perforated pipe would be placed only in the upper half of the pipe. Any fine particles that pass into the drainage element are allowed to migrate downwardly and through the slits 14 rather than accumulating and clogging the aggregate 12.

The invention thus provides a drainage element that is not only able to filter fine particles of solid material from effluent entering into the element but also avoids clogging of the discrete aggregate when in use. Further, the invention provides a drainage element that is able to pass large particles out of the bottom of the element that might otherwise be prevented from passing through the membrane.

What is claimed is:

1. A drainage element comprising a mass of discrete aggregate defining passageways for a flow of fluid therethrough; and a sleeve of water-permeable filter material encasing said mass of discrete aggregate, said sleeve having a longitudinally extending pattern of slits in a peripheral portion thereof, said peripheral portion constituting less than 50% of the total periphery of said sleeve.

2. A drainage element as set forth in claim 1 wherein said pattern of slits extends along at least one eighth of the longitudinal length of said sleeve.

3. A drainage element as set forth in claim 1 wherein said pattern of slits includes a plurality of longitudinally spaced apart sections of slits and said slits in each said section are disposed in parallel.

4. A drainage element as set forth in claim 3 wherein said slits are disposed coaxially of said sleeve.

5. A drainage element as set forth in claim 1 wherein said mass of discrete aggregate includes expanded polystyrene elements characterized in having been expanded from an initial state to an expanded state after filling of said sleeve therewith and in imparting a degree of rigidity to the drainage element in said expanded state sufficient to maintain an expanded three dimensional shape of said sleeve.

6. A drainage element as set forth in claim 5 wherein said slits are of oblong shape.

7. A drainage element as set forth in claim 6 wherein at least some of said slits have a width of 1/32 inch at the center of said oblong shape thereof.

8. A drainage element as set forth in claim 1 further comprising a perforated pipe extending through said aggregate and said sleeve.

* * * * *